United States Patent [19]

Louis

[11] Patent Number: 4,718,792

[45] Date of Patent: Jan. 12, 1988

[54] PREFABRICATED RETAINING-WALL ELEMENTS FOR PROTECTION, CONSOLIDATION AND/OR FACING OF EXCAVATIONS, GROUND ANCHOR AND ASSEMBLY DEVICES, AND PROCEDURE FOR APPLICATION OF THESE ELEMENTS AND DEVICES

[76] Inventor: Claude C. Louis, 40 Bis, Avenue Bosquet, 75007 Paris, France

[21] Appl. No.: 14,170

[22] Filed: Feb. 12, 1987

Related U.S. Application Data

[63] Continuation of Ser. No. 746,064, Jun. 18, 1985, abandoned.

[30] Foreign Application Priority Data

Jun. 29, 1984 [FR] France ..... 84 10336

[51] Int. Cl.[4] ..... E02D 29/02

[52] U.S. Cl. ..... 405/262; 405/36; 405/284

[58] Field of Search ..... 405/36, 153, 262, 284, 405/285, 286, 287

[56] References Cited

U.S. PATENT DOCUMENTS

| | | | |
|---|---|---|---|
| 3,198,614 | 8/1965 | Powell | 405/285 |
| 3,464,211 | 9/1969 | Andresen . | |
| 3,802,204 | 4/1974 | Mason | 405/262 |
| 3,922,864 | 12/1975 | Hilfiker . | |
| 4,117,686 | 10/1978 | Hilfiker | 405/284 |
| 4,318,637 | 3/1982 | Oger et al. | 405/153 |
| 4,426,176 | 1/1984 | Terada | 405/285 |
| 4,449,857 | 5/1984 | Davis | 405/286 |

FOREIGN PATENT DOCUMENTS

| | | |
|---|---|---|
| 3042967 | 7/1982 | Fed. Rep. of Germany . |
| 2228900 | 12/1974 | France . |
| 2415193 | 8/1979 | France . |
| 621174 | 1/1981 | Switzerland . |

OTHER PUBLICATIONS

"New Method for Supporting Cut Soils", by Claude Louis, Revue Travaux No. 553, Mar. 1981, pp. 67–75.

*Primary Examiner*—David H. Corbin

*Attorney, Agent, or Firm*—Larson and Taylor

[57] ABSTRACT

In this slope facing process, facing elements (4) are assembled in situ, their edges having means of jointing with adjacent elements; drainage (D) is provided over the whole height of the face (1) of an excavation between this face and the facing (R) of elements (4) behind which a void-filling material (B) is injected, consisting for example of lean mortar or a swelling material.

17 Claims, 17 Drawing Figures

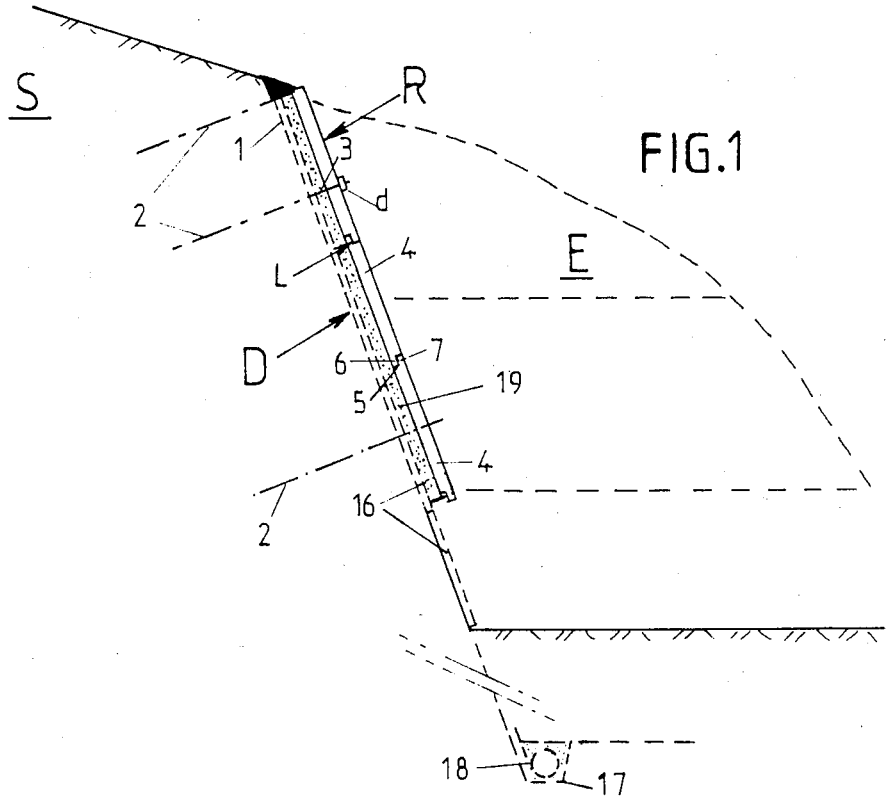
FIG.1
FIG.8
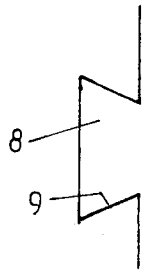
FIG.9
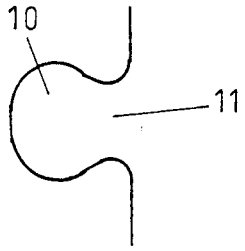

PREFABRICATED RETAINING-WALL ELEMENTS FOR PROTECTION, CONSOLIDATION AND/OR FACING OF EXCAVATIONS, GROUND ANCHOR AND ASSEMBLY DEVICES, AND PROCEDURE FOR APPLICATION OF THESE ELEMENTS AND DEVICES

This is a continuation of application Ser. No. 746,064, filed June 18, 1985, and now abandoned.

The invention concerns a process for facing and/or supporting natural slopes and artificial cuts such as cuttings, bands, trenches, pits, tunnels, etc. using ground anchors and facing and/or support elements fixed thereto.

The process concerns, among other things, the protection, consolidation and stabilization of ground slopes.

Various solutions have been put forward before which, generally, after the elements have been installed, require supplementary operations such as the pneumatic application of concrete on the elements, for example shotcrete over mesh reinforcement.

The main purpose of the invention is to provide a process for facing and/or supporting excavated faces that meet the various requirements of practical engineering better, and which, above all, enable the facing to be built with the minimum number of operations. It is also desirable for such a process to produce a facing which has good soundproofing qualities, which is watertight, and which has a pleasant appearance.

Under this invention, a process for facing and/or supporting excavated slopes of the type hereinabove defined is characterized by the fact that the facing elements are prefabricated with edges designed for connection to neighbouring elements, that the elements are assembled in situ, that drainage is provided over the whole height of the excavation between the excavated slope and the facing, and that the voids behind the prefabricated elements are filled with suitable material.

The prefabricated elements should preferably be solid, meaning that the total area of any openings left in the elements should be less than 30% of the total element area.

The system of prefabricated elements assembled in this way is self-stable under loads such as deadweight, and external loads such as earth pressure, water pressure, or other external forces.

Because of their stability, only half the total number of prefabricated elements used need to be attached to ground anchors (and thereby, only half the number of ground anchors are needed).

In the case of the prefabricated elements being of hexagonal or circular shape, the number of ground anchors, and therefore the number of prefabricated elements attached to these ground anchors, is only one third of the total number of prefabricated elements.

The packing material filling the voids behind can be a lean mortar or swelling material.

The prefabricated elements can be identical; adjacent elements can have alternate faces exposed.

The joints between the prefabricated elements may consist of "dry" type assemblies such as matching male and female slots or grooves, or joints requiring setting mixtures such as mortar, resin or other type of material, the edges of the prefabricated elements being provided with grooves for the said material.

The prefabricated elements are usually attached to their ground anchors after the void-filling material has been injected.

The invention also concerns prefabricated facing and/or support elements, especially for the implementation of a process as described hereinabove, these prefabricated elements being characterized in that, preferably, they are mainly solid (which means that the total area of any openings is less than 30% of the total area of the prefabricated element), and that they are provided with means of connecting them to adjacent elements around their edges.

The prefabricated elements to be attached to ground anchors may have a reinforced area with a hole for passing through the ground anchor, this reinforced area usually being near the centre of the element.

The prefabricated elements may be hexagonal or circular in shape. They can be made of concrete, binders or composite materials.

In addition to the arrangements hereinabove described, the invention consists of certain arrangements which will be described hereinunder in connection with particular methods of construction described with reference to the appended drawings, but which are not exhaustive or limiting.

FIG. 1 in these drawings is a schematic cross-sectional view of an excavation, the exposed face of which is lined by a method described in the invention.

FIGS. 8 to 14 are schematic illustrations of various types of joints that can be provided at adjacent edges of prefabricated elements.

Figure 2:
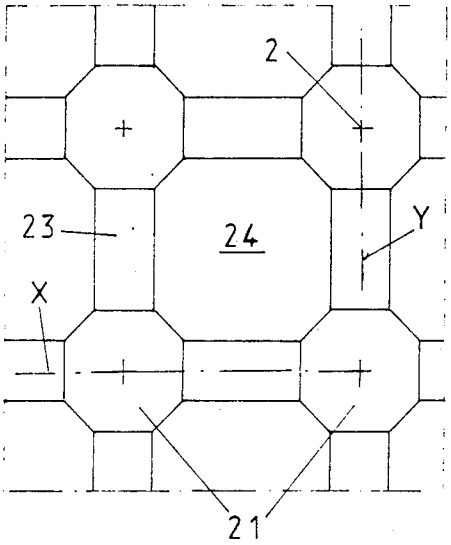
FIGS. 2 to 7 are elevations of various shapes and arrangements of prefabricated facing elements used in the process described in the invention.

Referring to these figures, especially FIG. 1, an excavation E has been made in ground S with an inclined face 1. Ground anchors 2 are cemented into the ground S and emerge on face 1, their exposed ends 3 being provided with methods of fastening such as screw threads suitable for an appropriate nut d.

Generally, anchors 2 are driven in the ground S with a percussion/vibration machine (not shown) ; alternatively a hole may be drilled in the ground and an anchor is introduced into this hole. The anchor 2 may be sealed in the ground, which remains in place, with cement or similar product.

The facing elements 4 are fixed to ground anchors 2.

The facing elements 4 consist of prefabricated elements that are chiefly solid, meaning that, if any opening are provided inside the circumference of an element 4, the total area of the openings is less than 30% of the total are of the whole element 4. Preferably, if one or more openings is provided in an element 4, each opening should not be larger than one-twentieth of the total area of the element 4. As a general but non-limiting guide, the element 4 may have an area of the order of one square meter.

The edges of elements 4 have means of connecting them L to the adjacent elements.

The elements 4 can be flat or curved, for example arcs of cylinders.

As illustrated in FIG. 1, the edges 5 of the elements have a rebate 6 to mid-thickness, to fit a similar rebate 7 on the adjoining element. If identical elements 4 are installed with alternate faces exposed, the rebate 7 will fit the rebate 6 as shown in FIG. 10, to provide a good connection between adjacent elements.

Figure 10:
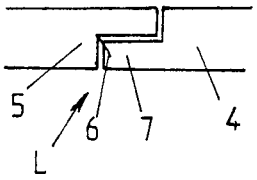

These joining systems L of the "dry" type, comprising essentially an assembly of tongues and grooves, can have shapes different from those shown on FIGS. 1 and 10. For example, the elements might have projections such as 8 (FIG. 8) of the dovetail type, to fit corresponding grooves in adjacent elements such as 9.

FIG. 9 shows another alternative type of joint, which can be provided on the edges of the elements 4, which consists of a sort of bead 10, with a circular head, and narrowing to a neck 11 at the edge of the panel. This bead 10 fits a similarly shaped slot, as in a jigsaw puzzle.

Figure 11:
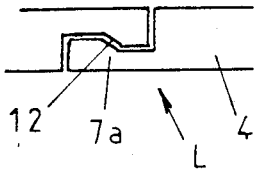

In the alternative shown in FIG. 11, which is similar to that in FIG. 10, part 7*a* is a rebate around the whole perimeter of the element, with a concave-convex surface 12, fitting the convex-concave rebate of the adjacent element, which has been turned over so that the other face is exposed.

Figure 12:
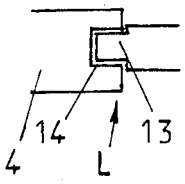

FIG. 12 shows connecting means L of the kind tenon 13/mortise 14, said tennon 13 being provided on the edge of one element while said mortise 14 is porivded on the edge of an adjacent element.

Other arrangements are possible for "dry" type connections; for example, the edges of adjacent elements could be set at right angles to the main surface of the element, so as to hook onto the edges of the adjacent element, which again would be turned over to expose the opposte face.

In the case of "dry" type connections, it is possible to provide matching male and female tongues and grooves, either in the plane of the element (alternative shown in FIGS. 8 and 9) or in cross section (alternative shown in FIGS. 10 to 12).

Figure 13:
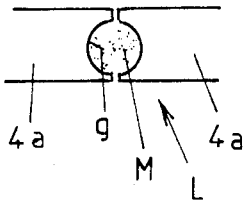
Figure 14:
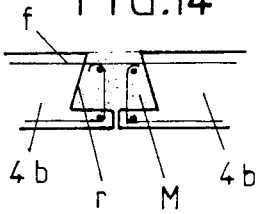

In another alternative (FIGS. 13, 14), the connections L are made by injecting a material M such as mortar, resin or other material between elements 4*a*, 4*b*, which have slots or grooves g, r around their edges to contain the sealing material. Steel bar f, fibre or similar strengthenhancing material can also be includes in the sealing material.

The facing elements 4 or 4*a*, 4*b* are assembled in situ and attached to the exposed ends 3 of the ground anchors.

The elements 4, 4*a*, 4*b* are installed as excavation E proceeds, from top to bottom.

Because the elements 4 are assembled together by connection L around their edges, the system, after assembly, is self-stable. An improvement of the invention is that the number of elements 4 to be attached to ground anchors 2 and therefore the number of ground anchors 2 is not more than half the total number of prefabricated elements.

Figure 6:
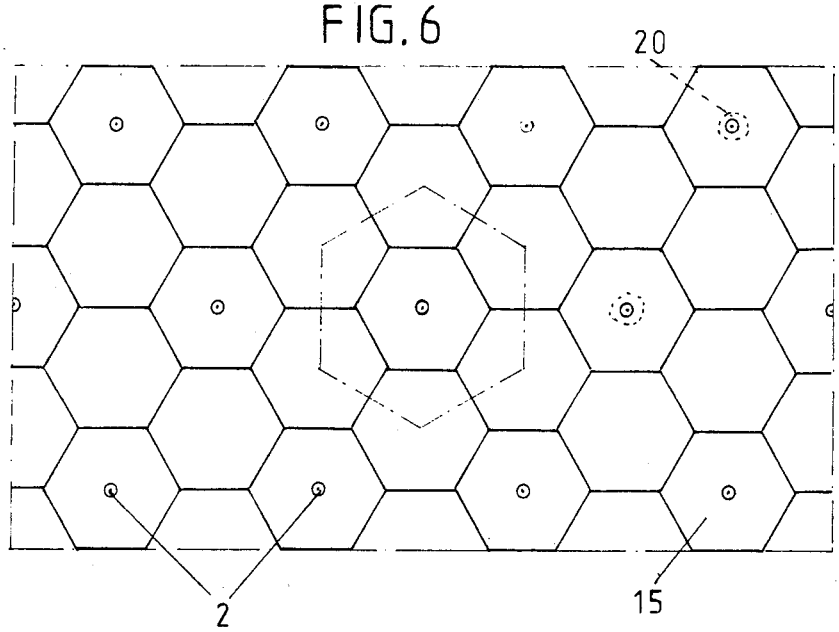

For example, referring to FIG. 6, using elements 4 consisting of panels 15 of regular hexagonal shape, only one panel out of three is fixed to a ground anchor 2; the number of ground anchors 2 is therefore only one-third of the total number of elements 15. The reduction in the number of ground anchors 2 contributes to the economy of the process in the invention.

Drainage D is provided over the whole height of the excavation slope 1, between the face 1 and the facing R.

The drainage may materially consist for example of a drainage curtain such as a layer 16 of fibres, including a layer of geotextile laid down the length of face 1. A ditch 17 with a drainpipe 18 is provided at the foot of the wall to collect the drainage water.

Another alternative for drainage D is to use perforated plastic pipe (not shown) laid along the excavation slope 1, running downwards.

After installation of the drainage D, a filling material B is injected behind the facing R, that is in the space 19 between the facing and the excavated surfacd 1. The material may be lean mortar or a swelling sand, or even sand alone.

The filling material B is injected through holes in the elements (either the ground anchor holes or special holes provided for that purpose).

Once the void has been filled with material B, and has hardened if applicable, the relevant facing elements 4 are fixed to the ground anchors 2, by applying a relatively moderate torque to the nuts d screwed on the ends of the projecting part 3 of the ground anchors. Once this has been done, the anchor heads and nuts can be covered, for example with concrete, to give the facing R its final permanent appearance.

Figure 15:
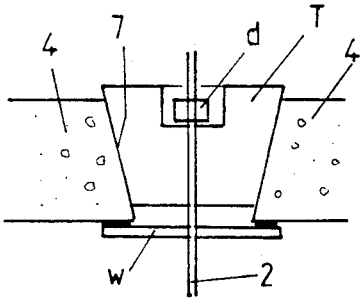
FIGS. 15 and 16 are schematic views of arrangements for attaching ground anchors, with self-wedging heads.
Figure 16:
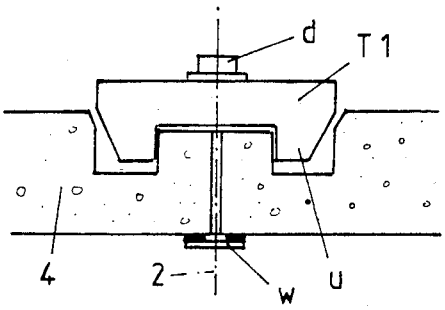

FIGS. 15 and 16 show devices for fixing the anchor heads, especially self-wedging heads between adjacent elements. In FIG. 15, the edges 7 of adjacent elements 4 are chamfered at roughly 60°–70° to the mean plane of the element. The ground anchor 2 passes between the edges of adjacent elements. A self-wedging head T, in strong material (metal, concrete, hard plastic), in the form of a truncated pyramid, or truncated cone, whose sides match those of the panel edges, acts like a wedge under the anchoring force, the head T being retained by the nut d. In FIG. 16, the head T1 is formed by a sort of plate with edges u turned over, and engaging in slots provided on the adjacent elements, again with a self-wedging action if required.

When attaching the ground anchors 2, they can be provided with an adjustable inside stop w (for example a metal plaque) (FIGS. 15, 16), to align the prefabricated elements correctly.

Panels such as elements 15 (FIG. 6) to be bolted to ground anchors 2 can advantageously have a reinforced area 20, where the thickness is increased, especially around the middle of the element, with a hole for ground anchor 2. The prefabricated elements 4 can be identical or complementary.

Figure 3:
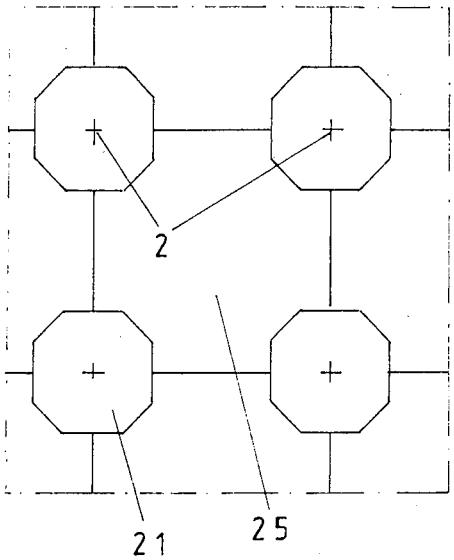
Figure 4:
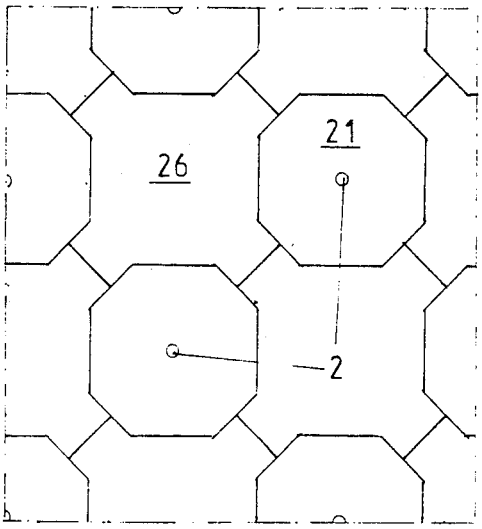

In the cases shown in FIGS. 2, 3 and 4, the facing R requires elements of different shapes.

In the case of FIG. 2, there are regular octogonal elements 21 attached to ground anchors 2. These elements 21, arranged in a manner similar to that shown in FIG. 16 at head T1, hold in position the elongated rectangular elements 22, 23 arranged along two orthogonal directions X and Y. The spaces 24 bounded by elements 21 and elements 22, 23 can be left open, or, if required, closed with other elements or other means capable of retaining the void-filling material B, if space 24 is large.

In the example shown in FIG. 3, the octagonal elements 21 are again fixed to ground anchors 2. They hold in place the prefabricated elements 25 of roughly square or rectangular shape, filling all the space between the centres of the four elements 21 at the corners of square or rectangle.

FIG. 4 shows an alternative in which the octagonal elements 21, fixed to ground anchors 2, maintain other square elements 26, one of whose diagonals is roughly vertical, and the other roughly horizontal. These prefabricated elements, of two different shapes, are fitted together in a predetermined pattern.

Figure 5:
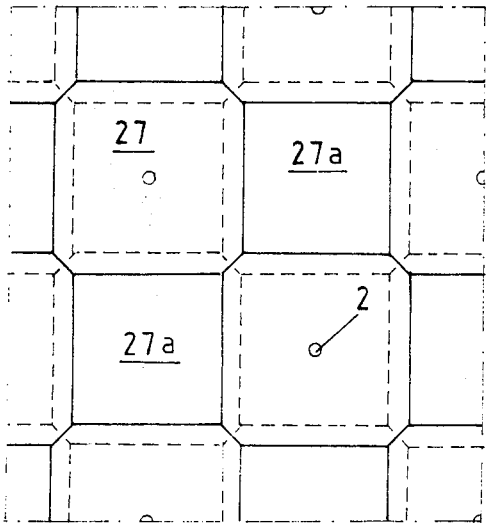

FIG. 5 shows a facing obtained by means of identical elements 27, square with chamfered corners. One element 27 is fixed to ground anchor 2, while the adjacent elements 27*a* are turned over so that their other face is exposed (in a similar way as shown in FIG. 1) to provide matching joints L, of the type shown in FIGS. 10 and 11, at the edges of these elements.

Figure 7:
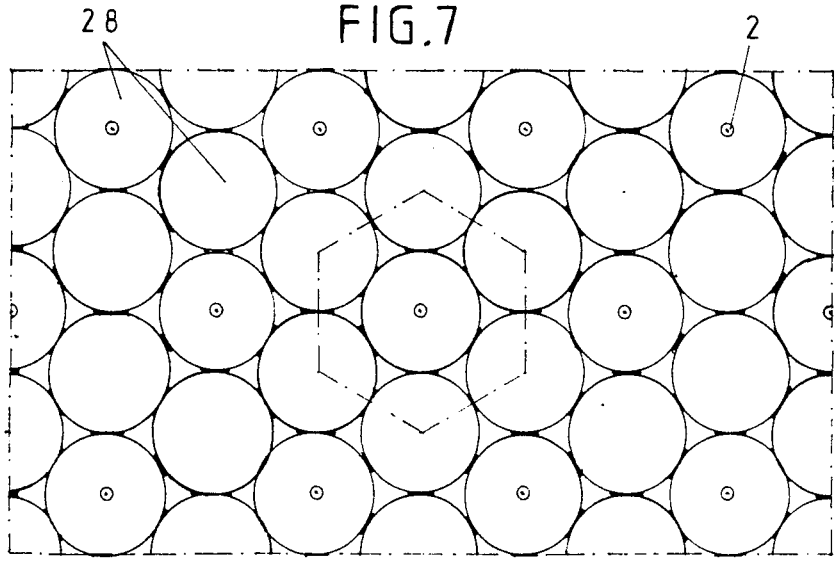

FIG. 7 shows an arrangement in which the prefabricated elements 28 are circular. One element out of every three, as in the case in FIG. 6, is attached to a ground anchor 2, the pattern of anchored elements with respect to unanchored elements being regular, as in FIG. 6.

This invention provides a process for rapidly building a facing to natural or artificial slopes offering attractive properties in respect of noise, particularly because of the nature of the surface, and in respect of appearance.

In certain applications, it may be useful to provide some sort of waterproofing between the drainage and the void-filling material.

Figure 17:
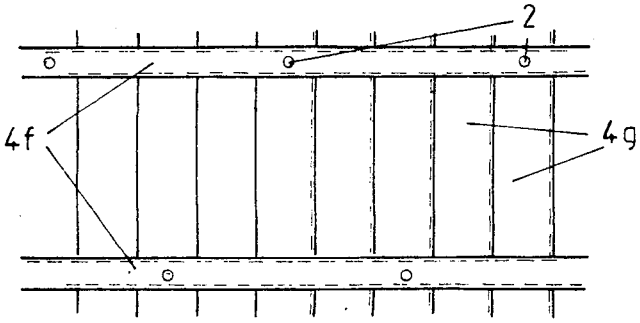
FIG. 17 illustrates an alternative type of arrangement.

FIG. 17 shows an alternative in which the longitudinal elements 4*f* (vertical, horizontal, oblique) are retained by ground anchors 2 at several points, to hold in place the transversal elements 4*g* forming the actual facing.

I claim:

1. A method for facing and/or supporting, with prefabricated facing elements, natural or artificial slopes of an excavation in the ground such as a cut, bank, trench, pit, tunnel, comprising the steps of:

(a) making in the ground an excavation having a face;

(b) providing a plurality of ground anchors having outer ends;

(c) driving the anchors into the ground, through the face of the excavation, and cementing the anchors into the ground, so that portions of the outer ends of the anchors project from the face to provide exposed ends;

(d) providing an adjustable stop on the outer end of each anchor, and adjusting the stop;

(e) positioning against the stops, on the exposed ends of the anchors, facing elements comprised of primarily solid prefabricated facing elements whose edges are provided with means for joining with adjacent elements, so that the adjusted stops align the prefabricated elements, and space the elements from the excavated face;

(f) providing drainage over the height of the excavation, between the face of the excavation and the prefabricated facing elements;

(g) injecting a filling material in the space between the facing elements and the excavated face; and (h) fixing the prefabricated elements to the ground anchors.

2. A method according to claim 1 in which each of a plurality of the prefabricated facing elements has a ground anchor hole into which the exposed end of the ground anchor extends when the facing element is positioned against a stop.

3. A method according to claim 2 in which the filling material is injected through the ground anchor hole of the facing elements.

4. A method according to claim 1, in which a plurality of said prefabricated elements have holes for injection of the filling material.

5. A method according to claim 2, in which a plurality of said prefabricated elements have additional holes for injection of the filling material.

6. A method according to claim 1, in which the exposed ends of the ground anchors pass between the edges of adjacent facing elements, and the end of each ground anchor is provided with a self wedging head.

7. A method according to claim 1 wherein the number of prefabricated facing elements attached to ground anchors, and therefore the number of ground anchors, is not more than one-half the total number of prefabricated elements forming the facing.

8. A method according to claim 7 wherein the prefabricated elements are hexagonal or circular in shape, and the number of prefabricated elements attached to ground anchors, and therefore the number of ground anchors, is not more than one-third the total number of prefabricated elements forming the facing.

9. A method according to claim 1 wherein the drainage comprises a drainage curtain.

10. A method according to claim 1 wherein the drainage comprises a drainage curtain of geotextile material.

11. A method according to claim 1 wherein the prefabricated facing elements are identical panels, and adjacent ones of said panels are positioned with opposite faces exposed.

12. A method according to claim 1 wherein at least two types of different prefabricated facing elements are used, and said facing elements are joined together in a predetermined pattern.

13. A method according to claim 1 wherein the edges of the prefabricated facing elements comprise dry type interfitting joints with mating projections and grooves.

14. A method according to claim 1 in which the step of adjusting the stop comprises threading the stop along a threaded portion of the outer end of the anchor.

15. A method according to claim 1 in which the step of fixing the facing elements to the anchors comprises tightening nuts threaded on the exposed ends of the anchors against the facing elements.

16. Prefabricated elements for the facing and/or support of excavation slopes, for implementing the method according to claim 1, said facing elements comprising mainly solid elements in which the total area of any openings therein is less than 30% of the total area of the element, and that the edges are provided with means for interfitting with adjacent facing elements.

17. Device for fixing adjacent elements to ground anchors, for implementation of the method according to claim 1, said device comprising a head, which can be self-wedging, held in place by a nut on a ground anchor passing between the edges of two adjacent elements.

* * * * *